United States Patent [19]

Frawley

[11] Patent Number: 4,508,404

[45] Date of Patent: Apr. 2, 1985

[54] REMOTE CONNECT AND DISCONNECT ASSEMBLY WITH ENERGY ISOLATION

[75] Inventor: Norman E. Frawley, Boulder, Colo.

[73] Assignee: Ball Corporation, Muncie, Ind.

[21] Appl. No.: 323,850

[22] Filed: Nov. 23, 1981

[51] Int. Cl.[3] ..... H01R 13/629

[52] U.S. Cl. ..... 339/45 M; 339/64 M; 339/75 M; 29/854; 29/869; 285/18; 285/21; 285/302; 285/319; 285/DIG. 22; 244/135 A; 244/161

[58] Field of Search ..... 141/348, 349, 353, 392, 141/387, 279; 285/302, 319, DIG. 22, 18, 21; 339/35, 36, 45 R, 45 M, 45 T, 75 R, 75 M, 64 R, 64 M; 29/854, 869; 114/249, 250; 244/135 A, 161

[56] References Cited

U.S. PATENT DOCUMENTS

| | | | |
|---|---|---|---|
| 940,678 | 11/1909 | Doane et al. | 285/319 |
| 2,955,850 | 10/1960 | Bellinger | 285/18 |
| 3,290,063 | 12/1966 | Haeber | 285/18 |
| 3,495,206 | 2/1970 | Pfister | 339/75 |
| 3,883,209 | 5/1975 | Kongelbeck | 339/64 R |
| 3,892,196 | 7/1975 | Swoboda, Jr. et al. | 114/249 |
| 3,908,925 | 9/1975 | Rinkleib et al. | 285/319 |
| 3,949,699 | 4/1976 | Heese et al. | 114/249 |
| 3,951,500 | 4/1976 | Anderson | 339/64 M |
| 3,976,347 | 8/1976 | Cooke, Sr. et al. | 339/35 |
| 4,018,409 | 4/1977 | Burch et al. | 244/161 |
| 4,076,361 | 2/1978 | Campbell | 339/75 M |
| 4,177,964 | 12/1979 | Hujsak et al. | 114/250 |
| 4,188,050 | 2/1980 | Lochte | 285/302 |
| 4,219,171 | 8/1980 | Rudmann | 244/161 |
| 4,268,071 | 5/1981 | Hanchen et al. | 285/18 |
| 4,300,737 | 11/1981 | Byrne et al. | 244/161 |
| 4,363,168 | 12/1982 | Bryer et al. | 166/341 |

FOREIGN PATENT DOCUMENTS

| | | | |
|---|---|---|---|
| 295753 | 5/1965 | Netherlands | 339/34 |

*Primary Examiner*—John McQuade
*Assistant Examiner*—Gary F. Paumen
*Attorney, Agent, or Firm*—Gilbert E. Alberding

[57] ABSTRACT

A method and apparatus are disclosed for remotely connecting, disconnecting and reconnecting a flexible communication member between two spaced apart bodies which are in predetermined relative positions to one another within given tolerances, and more particularly, to the connecting of an electrical connector to a carried spacecraft from an orbiter while providing for a minimum transfer of energy therebetween. A remote actuation of an electrical connector between two bodies is accomplished by driving an extendable member carrying a detachable connector from one of the bodies into mating contact with a fixed connector on the other body. A locking means associated with the other body retains the detachable connector in such mating contact while the extendable member is withdrawn. A flexible cable is first secured between said one of the bodies and the detachable connector.

14 Claims, 11 Drawing Figures

REMOTE CONNECT AND DISCONNECT ASSEMBLY WITH ENERGY ISOLATION

BACKGROUND OF THE INVENTION

The present invention relates to a method and apparatus for remotely connecting, disconnecting, and reconnecting a flexible communication member between two spaced apart bodies which are in predetermined relative positions to one another within given tolerances, and more particularly, to the connecting of an electrical connector to a carried spacecraft from an orbiter while providing for a minimum transfer of energy through the connecting apparatus.

At present the placement of a space vehicle into outer space requires a multistage rocket or propulsion system which is capable of only a single use. The rocket is also not recoverable and therefore constitutes a significant waste of sophisticated equipment and materials.

The advent of the space shuttle or orbiter promises considerable savings by minimizing such waste. The orbiter is capable of carrying into and recovering from space a variety of payloads. With many of these payloads it is necessary to provide an electrical connection between the orbiter and the payload for monitoring the payload prior to takeoff, during launch, and prior to deployment. In the future it may prove necessary to achieve communication between the orbiter and a spacecraft which has been restowed in the orbiter for troubleshooting or monitoring during descent and landing.

Apparatus capable of the above functions must meet a variety of criteria generally unique to space travel. The device must be capable of remote operation in outer space. It must accommodate the position tolerances between the spacecraft and the orbiter, especially after restow when manual positioning may be impractical. After connection and during launch, travel and landing, the device must allow for a dynamic envelope between the spacecraft and the orbiter to minimize the transfer of energy such as acceleration loading, vibration, and heat. The device must also be reliably remotely disconnectable yet maintain electrical connection during launch, travel and landings.

Before the present invention, a device which would perform within the above criteria was not available.

SUMMARY OF THE INVENTION

In accordance with the present invention, an extendable member is attached to the orbiter proximate the mounted space vehicle. The extendable member carries a detachable connector which has a flexible communication member or cable attached to it from the orbiter. Upon extension, the detachable connector is placed in mating contact with a fixed connector on the spacecraft. A locking means associated with the fixed connector retains the detachable connector in a mating relationship with the fixed connector. The extendable member is then retracted leaving the spacecraft and the orbiter connected through the communication member or cable thereby minimizing any energy transfer.

BRIEF DESCRIPTION OF THE DRAWINGS

A detailed understanding of the present invention and of preferred embodiments thereof will be accomplished by reference to the following detailed description, the appended claims and the drawings, wherein:

DETAILED DESCRIPTION OF THE INVENTION

Figure 1:
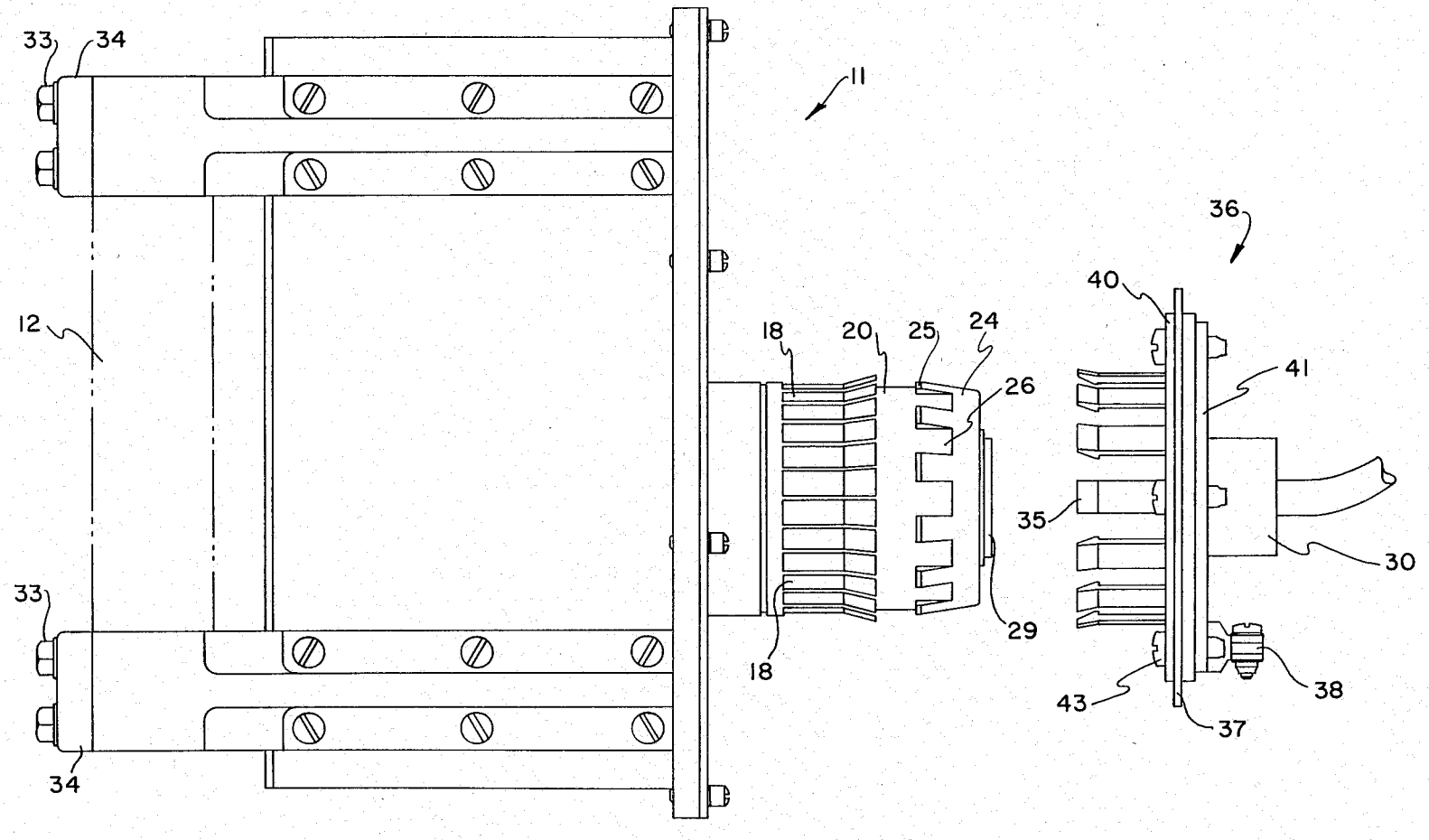
FIG. 1 is a top view of a preferred embodiment of an apparatus constructed in accordance with the present invention prior to connection or subsequent to disconnection.

While this invention is susceptible of embodiment in many different forms, there is shown in the drawings and will be herein described in detail, two specific embodiments, with the understanding that the present disclosure is to be considered as an exemplification of the principles of the invention and is not intended to limit the invention to the embodiments illustrated.

Referring to FIG. 1, a first preferred embodiment of the present invention is illustrated. An Orbiter Interface Box (OIB) 11, is secured to a rail 12 on the orbiter by bolt 33 and L-shaped plate 34. The OIB is an easily installed and removed piece of flight support equipment which serves as an interface for all connections from the orbiter to the carried spacecraft. A plurality of electrical connectors, 17, on the exterior surface of the OIB provide further convenience in attaching all control and support systems to the OIB.

For connection to a spacecraft, the OIB is provided with a fixed tube 21 (FIG. 2) having a pinion drive 16 associated with it; a slideably mounted umbilical tube 13 having a rack 15 in engagement with said pinion; an umbilical connector support ring 20, carried by said umbilical tube; and a coiled flexible umbilical cable 23 attached between an umbilical connector 29 and exterior connectors 17.

A plurality of inwardly biased fingers 18, extend from one end of the umbilical tube into engagement with the outer surface of the umbilical connector support ring 20. The support ring is provided with an annular groove 22 (FIG. 3) which said fingers securely engage. At the other end of the support ring a tapered nose cone 24 (FIG. 1) terminates in a series of alternating notches or stepped surfaces 25 with uninterrupted surfaces or spaces 26 between said steps or notches. The umbilical electrical connector, 29, is secured in a channel 42 (FIG. 2) which frees the connector for limited movement relative to the support ring. A coil spring 39 biases the connector forward in channel 42.

Attached to the spacecraft is a spacecraft connector assembly 36, which includes a plurality of spring pawls 35 mounted to a first plate 40; a second plate 41 connected to said first plate 40 by a series of bolts 43; a mounting bracket 37 interposed between said first and second plates and having a plurality of circumferential slots to accommodate and allow limited rotational movement of said bolts; a solenoid 38 attached to said mounting bracket 37 and said second plate 41; and a spacecraft electrical connector 30. Spacecraft electrical connector 30 and umbilical connector 29 are, of course, mateable and preferably of the self-centering type.

In operation, the OIB is secured to the orbiter and attached to the orbiting systems through connectors 17. The OIB and the spacecraft connector assembly 36 are then in the relative positions of FIG. 1. Prior to launch, during travel, or prior to deployment, the spacecraft may be remotely connected to the orbiter. To initiate the connect sequence, the umbilical tube 13 is extended by supplying power to a pinion drive motor which rotates pinion 16. The rack is then extended as is the attached umbilical tube. As the tapered nose cone 24 engages spring pawls 35, the support ring is centered in the hooked fingers.

Figure 2:
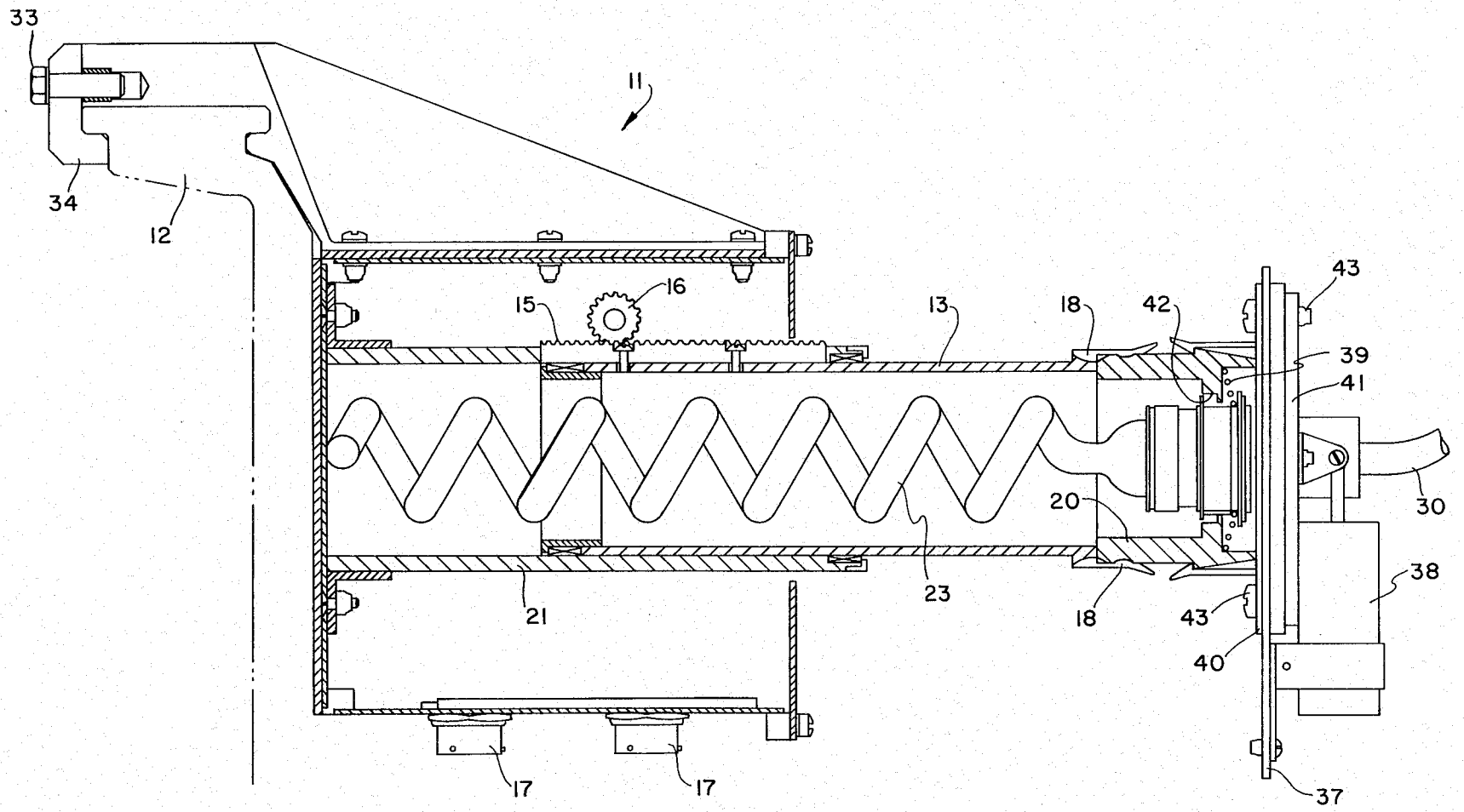
FIG. 2 is a cross-sectional view of the apparatus of FIG. 1 with the electronical connection completed.
Figure 3:
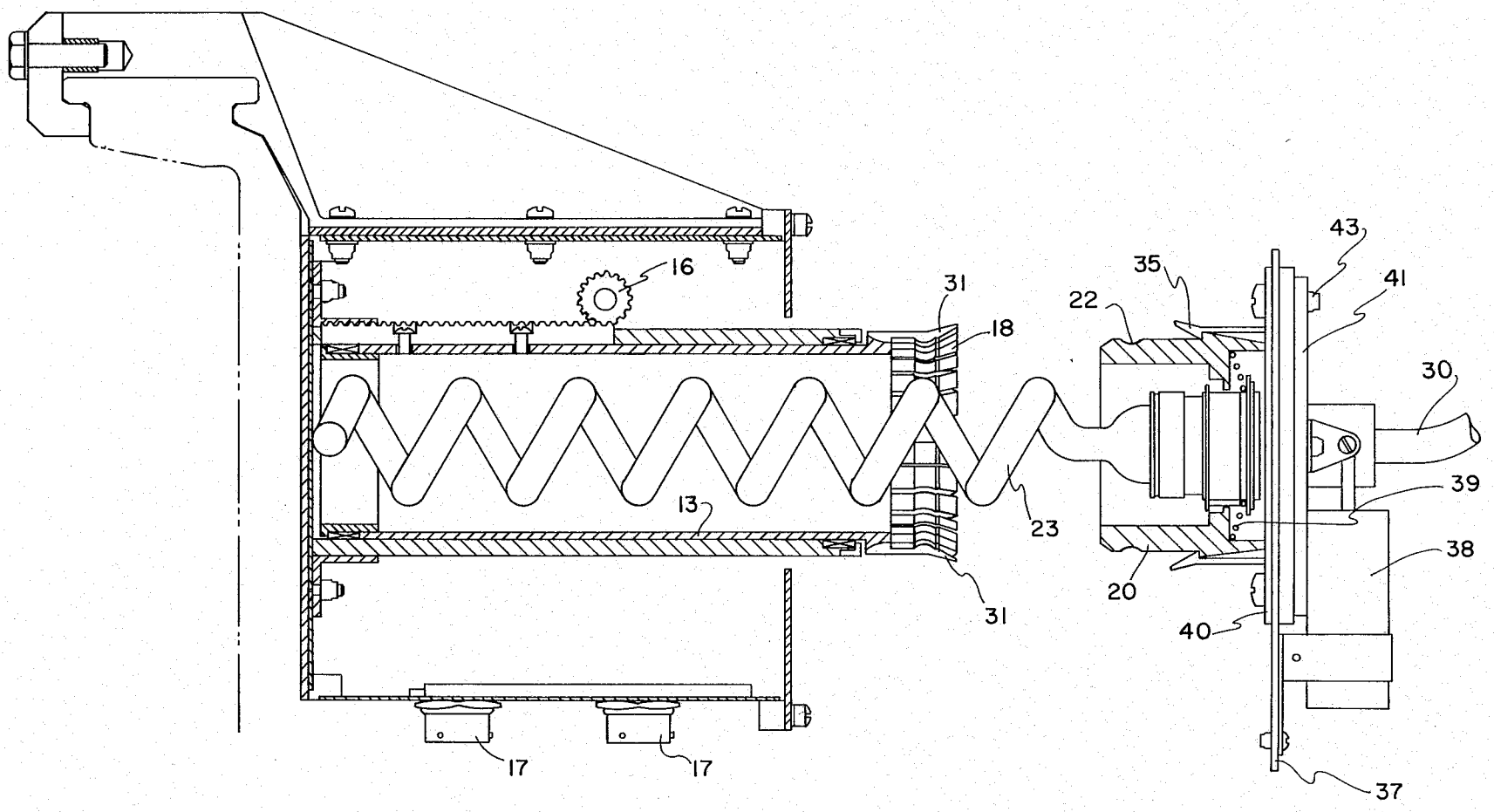
FIG. 3 is a cross-sectional view of the apparatus of FIGS. 1 and 2 with the detachable connector locked in mating position with the fixed connector and the extendable member withdrawn.

After the umbilical connector support ring 20 is centered, contact is initiated between umbilical electrical connector 29 and spacecraft electrical connector 30. The self-centering action of the preferred connectors is then allowed by the spring and channel mounting system of the umbilical electrical connector. The umbilical connector support ring continues to extend into the grasp of the pawled springs 35 until the pawls drop over the stepped surfaces 25 as shown in FIGS. 2 and 3. At this point, the system is as shown in FIG. 2. The umbilical electrical connector should be biased in full mating position with the spacecraft electrical connector by spring 39.

The pinion drive motor is then stopped and reversed. The preferred method of timing stoppage of the pinion drive is through a control system which monitors the completion of an electrical connection between the spacecraft and umbilical connectors. The motor stoppage may be shortly delayed after such completion to assure complete engagement of the spring pawls with the umbilical connector support ring.

The remote connector assembly may remain in the configuration of FIG. 2 when the orbiter is in a stationary mode such as on the launching pad or in orbit. During launch and travel through the atmosphere, the configuration of FIG. 2 would result in the transfer of an unacceptable amount of energy from the orbiter to the spacecraft, including possible loads due to relative motion, which could cause damage to the connector or to the spacecraft itself. It will be appreciated by those skilled in the art, that a certain amount of relative motion is possible between the spacecraft and the orbiter. This is commonly referred to as the "dynamic envelope" between the spacecraft and the orbiter.

Therefore, the pinion motor is reversed, withdrawing the umbilical tube. As the umbilical connector support ring 20 is firmly locked to the spacecraft by the action of the spring pawls 35 on stepped surfaces 25, retraction of the umbilical tube results in the biased fingers 18, which extend from the umbilical tube and grasp the support ring 20, riding outward over annular groove 22 and eventually releasing the support ring 20.

The pinion continues to drive the umbilical tube until the fully retracted position of FIG. 3 is attained. The only connection between the spacecraft and the OIB is then the flexible umbilical cable 23 thereby minimizing the transfer of any energy or loads and allowing relative movement between the two structures within the dynamic envelope.

Reconnection is simply accomplished by extending the umbilical tube. The biased fingers are limited in their inward piviting and have outwardly curved extremities 31 thereby accommodating the position tolerances between the two structures. The fingers contact the umbilical connector support ring 20 and ride over and down into the annular groove thereby firmly grasping the support ring 20 as shown in FIG. 2.

Solenoid 38 is then triggered, rotating the spring pawls off of the stepped surfaces to the uninterrupted adjacent surfaces or spaces 26. The support ring 20 is then no longer held by the spring pawls 35 and will be withdrawn upon retraction of the umbilical tube to its original position of FIG. 1.

This process may be repeated an indefinite number of times. When the electric current to the solenoid 38 is shut off, the solenoid will go back to its original orientation to position the spring pawls to grasp the stepped surfaces on the support ring 20 and the connect cycle may then again be initiated.

Figure 4:
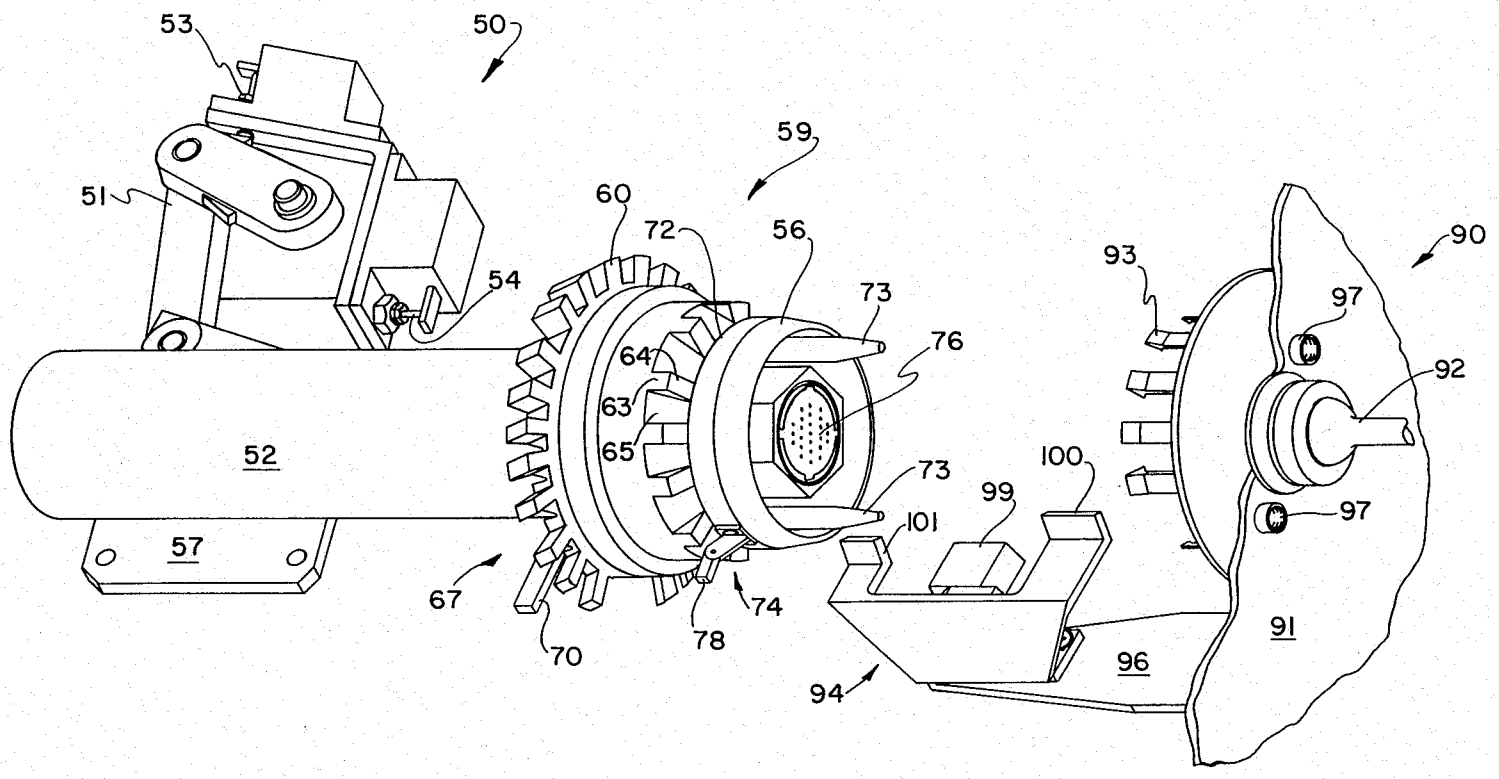
FIG. 4 is an isometric view of an alternative preferred embodiment of the present invention.
Figure 5:
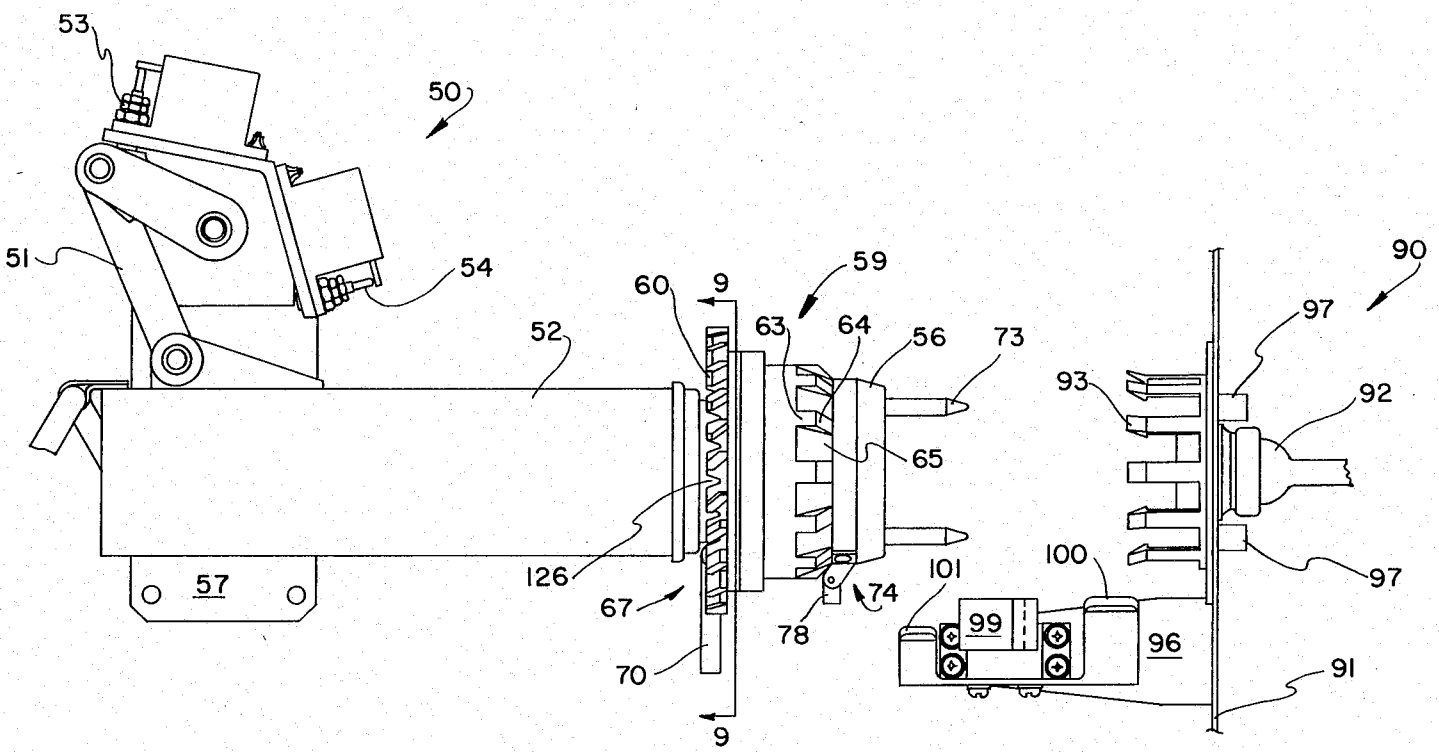
FIG. 5 is a side view of the alternative embodiment of FIG. 4 prior to connection or subsequent to disconnection.
Figure 6:
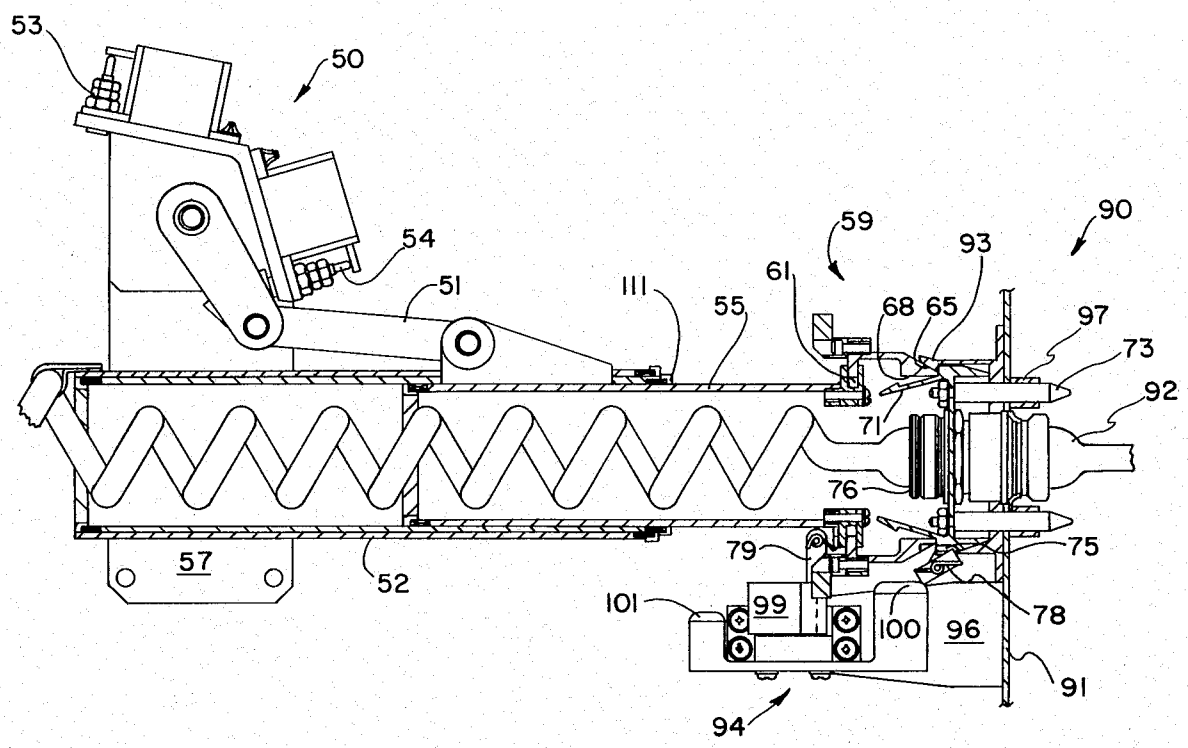
FIG. 6 is a cross-sectional view of the apparatus of FIG. 4 immediately after electrical engagement between the umbilical connector and the spacecraft connector.

An alternative preferred embodiment to the present invention is illustrated in FIGS. 4 through 11. Referring to FIG. 4, a mounting plate 57 is provided for mounting of the umbilical connector to the orbiter. Secured to the plate are fixed tube 52 and associated motor-gearbox module 50. A linkage 51 transmits the rotational movement of motor-gearbox 50 to horizontal movement of a slideably mounted umbilical tube 55 (FIG. 6). Although not shown, an Orbiter Interface Box, such as is in the first preferred embodiment, may be conveniently integrated with mounting plate 57.

Figure 7:
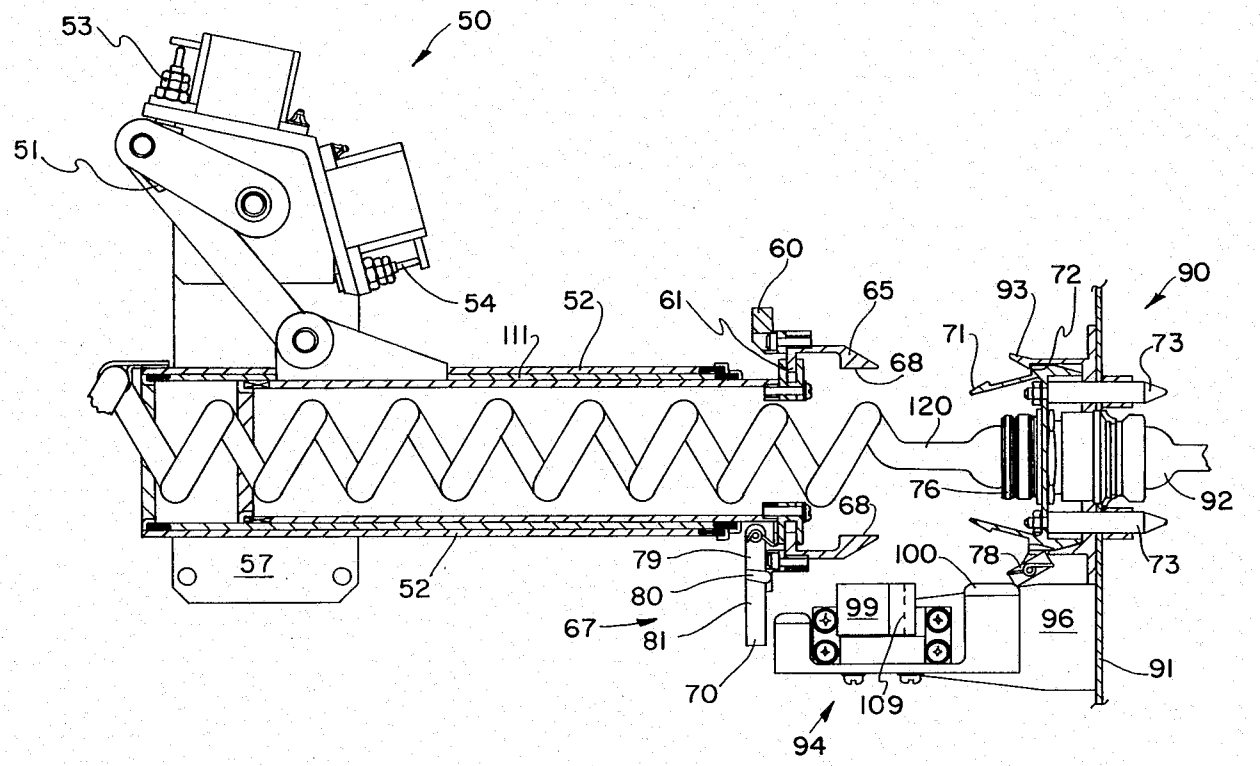
FIG. 7 is a cross-sectional view of the apparatus of FIG. 4 with the umbilical connector locked in mating position with the spacecraft connector and the extendable member withdrawn.

Connector head assembly 59 is mounted to the end of umbilical tube 55 through a tongue-and-groove arrangement generally referenced 61 (FIG. 7). A wave-spring 79 (FIG. 9) or other spacing means is placed between the tongue-and-groove arrangement 61 to provide a biased centering of the connector head assembly 59, yet allowing free rotational and limited radial movement of the connector head assembly 59 relative to the umbilical tube 55.

The connector head assembly includes a plurality of radial ears 60; outer stepped surfaces 63 having spreading surfaces 64; indented outer clearing surfaces 65 between said outer stepped surfaces 63; inner stepped surfaces 66 (FIG. 8) having inner clearing surfaces 68 (FIG. 7) therebetween; and a detachable umbilical connector support ring 56.

An antirotation arm assembly 67 is provided to control the free rotational movement of the connector head assembly which tongue-and-groove arrangement 61 allows. As is better shown in FIGS. 7 and 10 the antirotation arm assembly includes an arm 70 which has a hinge 80 separating said arm into an upper part 79 and lower part 81. The arm is pivotably attached to umbilical tube 55 and rotationally biased to engage a slot 126 between two of the radial ears 60 on the connector head assembly thereby restraining the connector head assembly 59 against rotational movement when so engaged.

Figure 8:
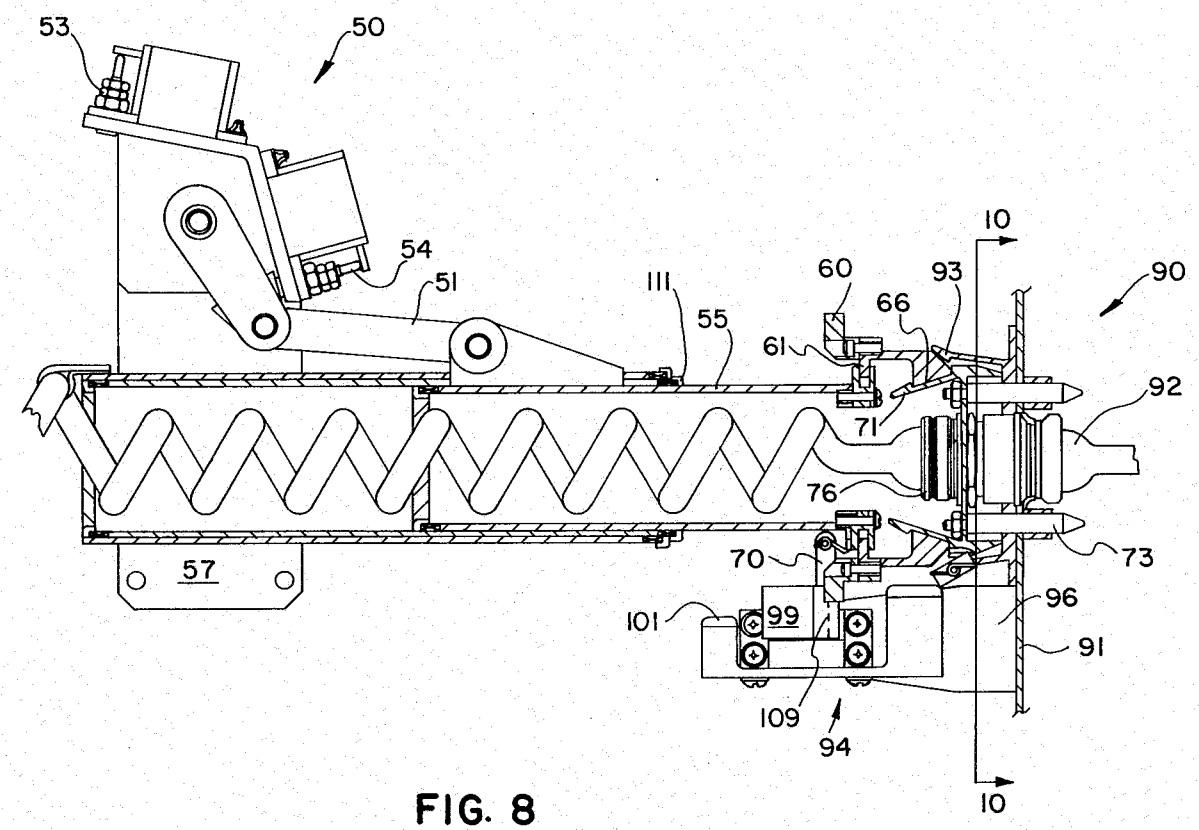
FIG. 8 is a cross-sectional view of the apparatus of FIG. 4 just prior to disengagement of the umbilical connector from the spacecraft connector.
Figure 10:
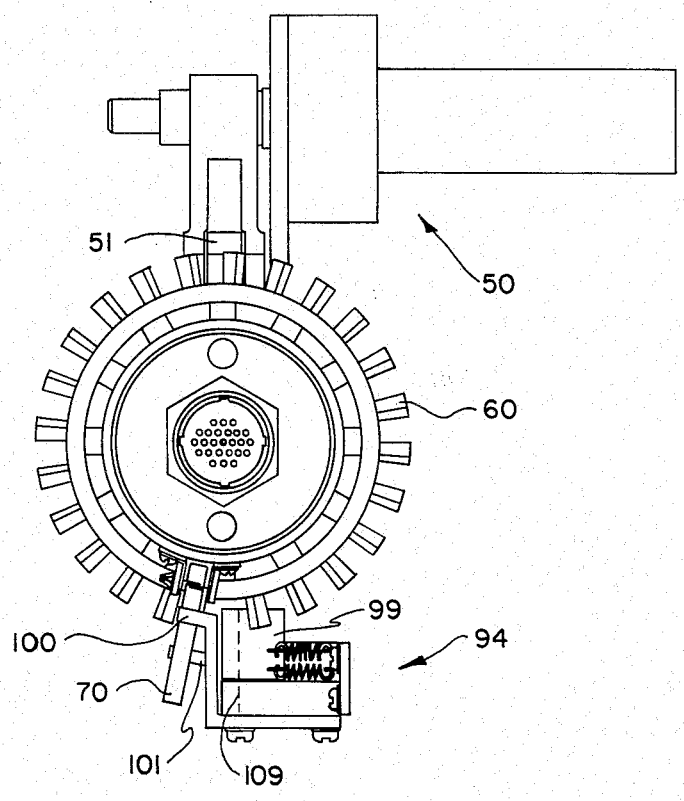
FIG. 10 is the front view indicated at line 10'—10' of FIG. 8.
Figure 9:
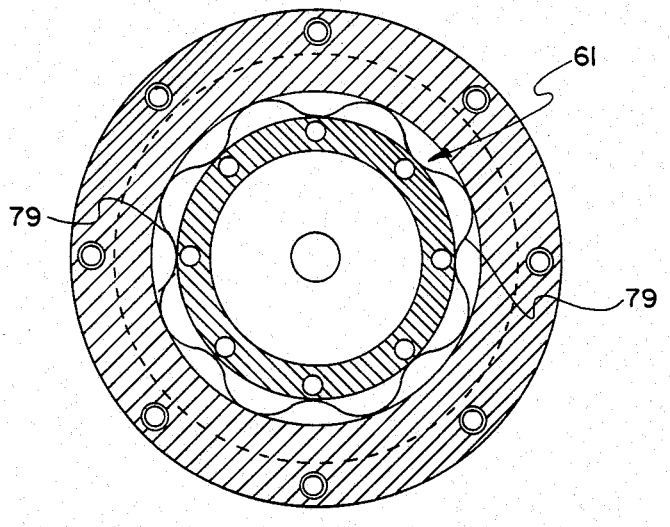
FIG. 9 is the cross-sectional view indicated by line 9'—9' of FIG. 5.

The umbilical connector support ring 56 carries the umbilical connector 76 and guide pins 73. When the alternative embodiment is in the preengagement position of FIGS. 4 and 5 the umbilical connector support ring 56 is secured to the connector head assembly by a plurality of spaced apart spring latches 71 which grasp the inner stepped surfaces 66 of the connector head assembly 59 as shown in FIG. 8.

The antirotation pin assembly 74 (FIG. 5) maintains the rotational orientation of the umbilical connector support ring 56 to the connector head assembly 59. This assembly includes a pin 78 which is mounted on the umbilical connector support ring 56 and is biased to lodge adjacent indented outer clearing surface 65 between two outer stepped surfaces 63 or optionally, indented outer clearing surfaces 65 may be provided with a detent 75 (FIG. 6) to receive said pin. As should be apparent from the above description and drawings, the antirotation arm assembly 67 and antirotation pin assembly 74 maintain the rotational orientation of the umbilical connector support ring 56 relative to fixed tube 55 when in the disengaged position as in FIGS. 4 and 5.

A spacecraft connector assembly 90 is secured to the spacecraft through mounting plate 91. A plurality of spring pawls 93 grasp circular notch 72 on the umbilical connector support ring 56 thereby retaining the umbilical connector 76 in engagement with spacecraft connector 92. A ramp and antirotational disengagement assembly 94 extend from mounting plate 91 by bracket 96. Ramp 99 is positioned to engage one of ears 60 and provide a predetermined rotational movement upon forward movement of the connector head assembly. Antirotational disengagement devices 100 and 101 are positioned for respective contact with antirotation pin 74 and antirotation arm 70 disengaging them from their locked position and thereby allowing independent relative rotational movement of connector head assembly 59 while umbilical connector support ring 56 is stabilized by guiding pins 73 in receptacles 97. As is better illustrated in FIG. 10, ramp 99 is spring biased and pivotable on axis 109.

In operation, movement of the device is initiated from the preengagement position of FIG. 4 or 5. The antirotation pin and arm assemblies are in their locked position and maintain the umbilical connector in the proper orientation for mating with the spacecraft connector. Actuation of the device results in motor-gearbox module 50 horizontally extending umbilical tube 55 and carried umbilical connector support ring 56 into engagement with the spacecraft connector assembly. Limit switch 54 is positioned to halt the extension of the umbilical tube when spacecraft connector 92 and umbilical connector 76 are firmly mated, which is illustrated in FIG. 6. Referring to FIG. 8, inner stepped surfaces 66 of connector assembly 59 and spring latches 71 are engaged as therein illustrated when the umbilical connector is in the initiation position of FIGS. 4 and 5. Further, antirotation pin 78 and antirotation arm 70 are firmly engaged to maintain the orientation of connector 76 prior to and during extension. As the connector head assembly approaches the spacecraft connector assembly, guiding pins 73 begin to enter the spacecraft assembly thereby stabilizing the umbilical connector support ring against rotational movement and guiding the umbilical connector 76 into mating position with the spacecraft connector 92. Right after the guiding pins enter the spacecraft assembly, antirotation pin 78 and antirotation arm 70 contact disengagement devices 100 and 101 and are rotated out of their locking position thereby allowing free rotational movement of connector head assembly 59. Upon further horizontal movement one of ears 60 engage ramp 99 and ride up the ramp rotating the connector head assembly 59 approximately 15° in the illustrated embodiment. This rotation results in inner stepped surfaces 66 sliding off spring latches 71 thereby providing inner clearing surfaces 68 adjacent said latch surfaces and disconnecting umbilical connector support ring 56 from connector head assembly 59. The apparatus is then in the configuration of FIG. 6 with spring pawls 93 from the spacecraft assembly positioned adjacent indented outer clearing surfaces 65 and firmly grasping circular notch 72 and retaining the umbilical connector support ring in mating contact with the spacecraft connector assembly 90.

In this preferred embodiment as soon as limit switch 54 is engaged indicating complete extension of umbilical tube 55, motor-gearbox module 50 reverses direction and returns to its original position as controlled by limit switch 53. As the connector head assembly moves past ramp 99, the ear adjacent to the previously engaged ear will strike ramp 99 and the spring biasing will allow said ramp to pivot on axis 109 thereby not disturbing the rotational position of the connector head assembly 59. At this point the spacecraft and umbilical connectors are in mating position and communication between the spacecraft and orbiter has been established through umbilical cable 120 as shown in FIG. 7.

The umbilical connector support ring and umbilical connector will be disengaged by again actuating motor-gearbox module 50. The umbilical tube and carried connector head assembly is again extended past ramp and antirotational disengagement device 94 into engagement with umbilical connector support ring 56. In passing ramp and antirotational disengagement device 94 antirotation arm 70 is again disengaged allowing a 15-degree rotation of connector head assembly 59 by engagement between one of ears 60 and ramp 99. This results in a return to the position illustrated in FIG. 8 of the drawings. Inner stepped surface 66 is in engagement with spring latches 71 of umbilical connector support ring while spreading surfaces 64 on outer stepped surfaces 63 spread spring pawls 93 disengaging said pawls from circular groove 72 and allowing retrieval of the connector head assembly and carried umbilical connector. Upon return the umbilical connector is again in the initial position depicted in FIGS. 4 and 5 with inner stepped surfaces 66 and spring latches 71 in the position of FIG. 8, ready to again establish connection upon command.

To maintain the connector head assembly in the proper position when being withdrawn past ramp 99, antirotation lever 70 is allowed to slip past antirotational disengagement device 101 and lock into position in one of the slots 126. Upon being withdrawn, the lower portion 81 of the antirotation arm will strike disengagement device 101 and bend at hinge 80 with the lower portion 81 riding over antirotational disengagement device 101 and snapping back into position. This will assure deflection of the spring biased ramp rather than back rotation of the connector head assembly which, if not presented, could result in improper rotational orientation of the connector head assembly for the next actuation of the device.

It should be noted that in the described alternative embodiment ramp 99 provides for 15-degree rotation of the connector head assembly upon each forward movement. Although the device will function with other than a 15-degree rotation, the spacing of ears 60, outer stepped surfaces 63, indented outer clearing surfaces 65, inner stepped surfaces 66, and inner clearing surfaces 68 are all dependent upon the angular rotation provided by ramp 99. Essentially, ears 60 should be spaced at intervals corresponding to the rotation (15 degrees in the described embodiment) and all inner and outer clearing and stepped surfaces should be centered at intervals of double the rotation angle (30 degrees in the described embodiment).

As will be apparent to those skilled in the art, where the device is to be used in repetitive situations, an angular rotation should be picked which when divided into 360 degrees results in an even integer. Where the device is only to be used for a limited number of cycles and then can be reset to the starting position, the angular rotation may be arbitrarily picked as long as the above discussed ears, clearing surfaces, and stepped surfaces are correspondingly spaced.

As should be apparent from the above discussion, the described device with 15-degree rotation may be actuated an indefinite number of times without resetting. In all cases, the first actuation of the umbilical tube will result in a connection between the spacecraft and the orbiter as illustrated in FIG. 7 with the intermediate position of FIG. 6. The second actuation of the device will retrieve the umbilical connector support ring resulting in the position of FIG. 4 or 5 with the intermediate position of FIG. 8.

Figure 11:
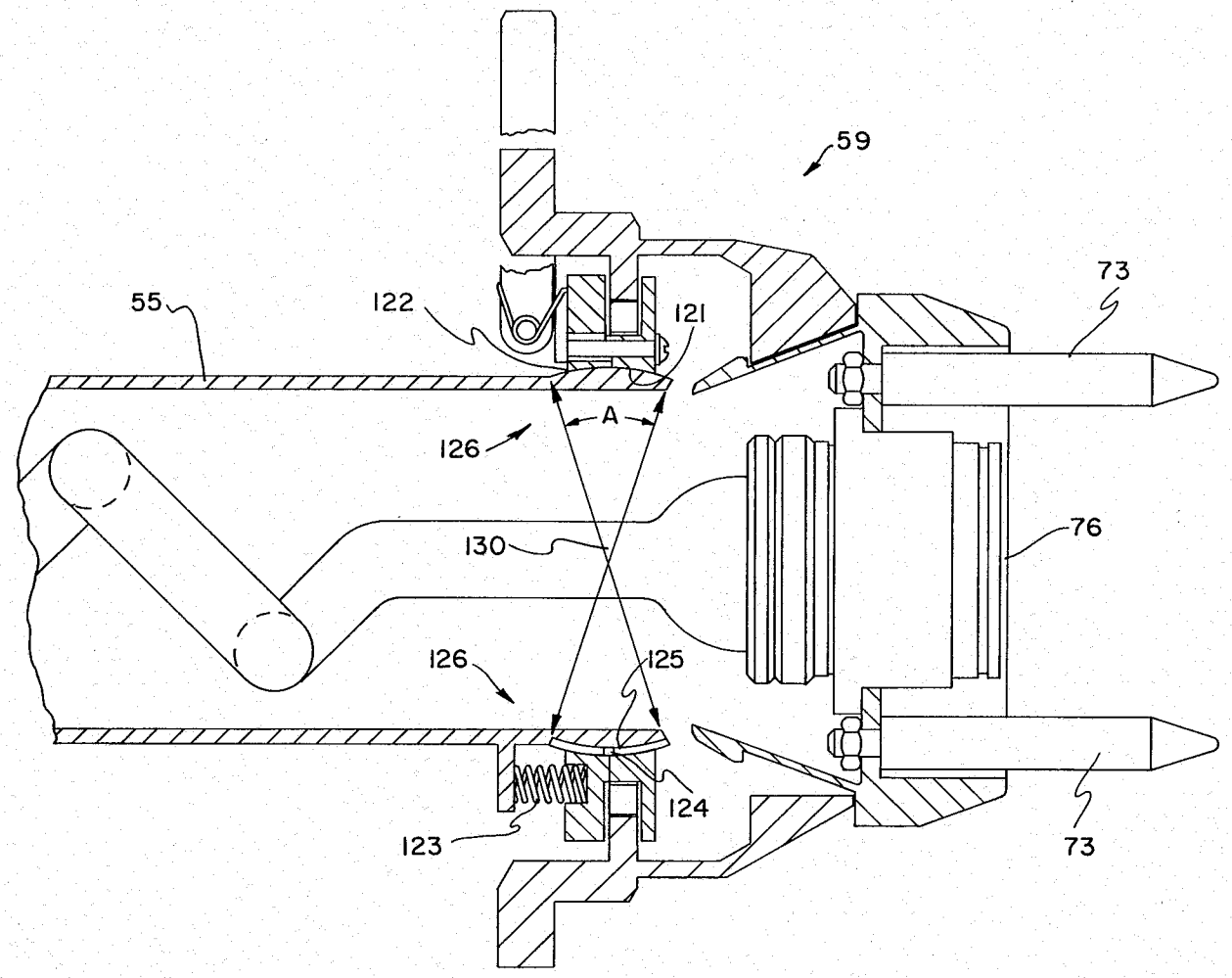
FIG. 11 illustrates an optional mounting for the connector head assembly which corrects for angular misalignment.

Referring to FIG. 11, an optional mounting generally referenced 126 for connector head assembly 59 is illustrated which corrects for, up to a predetermined limit, angular misalignment between the umbilical connector 76 and the spacecraft connector 92. The mounting includes an annular spherical convex surface 122 around the umbilical tube 55; a mating annular spherical concave surface 121 around the inner periphery of the connector head assembly; a longitudinal slot 125 in the annular convex surface; an antirotation pin 124 extending from the annular concave surface into the longitudinal slot; and a plurality of peripherally spaced alignment springs 123 between the umbilical tube and the connector head assembly. The annular spherical surfaces are on radii from pivot point 130 of the connector head assembly.

As the connector head assembly approaches the spacecraft, guiding pins 73 enter holes 97 in spacecraft assembly 90. The guiding pins are tapered which results in a progressively increasing alignment of the two connectors as the pins are further inserted in holes 97 and as the umbilical connector 76 approaches the spacecraft connector 92. This alignment is allowed by the spherical surface interface between connector head assembly 59 and the umbilical tube 55. Also tongue-and-groove arrangement 61 and wave spring 79 allow for radial movement of the connector head assembly to align the spacecraft and umbilical connectors. In the depicted embodiment the spherical surfaces cover about a five degree arc which allows for misalignment tolerances of up to five degrees. The slot 125 and pin 124 prevent rotational movement about the longitudinal axis of the mounting between surfaces 121 and 122 yet allows free angular movement of the umbilical connector relative to the umbilical tube.

To increase the reliability of the device and specifically, to reduce the risk of cold welds between metal parts in outer space, a degree of redundancy between moving parts may be provided such as redundant tube 111 between fixed tube 52 and umbilical tube 55.

Although a number of novel devices are utilized in a coacting manner in the two described embodiments, the present invention also contemplates the employment of more conventional subsystems which achieve the same result. For example, the extendable members need not be tubular, although in the preferred embodiments, the tubular configuration provides protection to the cable over the majority of its length. In its broadest aspects, the present invention contemplates the remote actuation of an electrical connection between a space shuttle and a carried spacecraft by driving an extendable member carrying a connector into mating contact with a second connector. To minimize the transfer of energy between the spacecraft and the space shuttle, the carried connector should be detachable and capable of being locked into contact while the extendable member is retracted. Further flexibility may be achieved by providing for reattachment and unlocking of the carried connector for disconnecting the electrical connection. In a preferred embodiment, the detachable connector is self-centering and carried in a receptacle which is provided with a channel and spring to bias the connector into electrical contact and allow for position tolerances. As the preferred embodiment is designed for space applications, reliability is of the highest priority and is achieved through the positive and simple operation of the various compounds.

What is claimed is:

1. An apparatus for remotely connecting two spaced apart bodies which are in predetermined relative positions to one another within given tolerances, comprising:

an extendable member attached to one of said bodies, said extendable member capable of remote actuation and including a misalignment device, said misalignment device comprising an annular spherical convex surface and a mating annular spherical concave surface, said surfaces being in biased axial alignment through a plurality of circumferentially placed springs;

a first connector carried by said extendable member;

a communication member attached to said first connector and said one of said bodies;

a second connector, mateable with said first connector, located on the other of said bodies and located such that actuation of said extendable member will bring said first connector into mating contact with said second connector.

2. An apparatus for remotely connecting two spaced apart bodies which are in predetermined relative positions to one another within given tolerances while providing for a minimum of energy transfer through the connection, comprising:

an extendable member attached to one of said bodies and capable of remote actuation, said extendable member including a misalignment device, said misalignment device comprising an annular spherical convex surface and a mating annular spherical concave surface, said surfaces being in biased axial alignment through a plurality of circumferentially placed springs;

a detachable connector carried by said extendable member and detachable therefrom;

a communication member attached between said detachable connector and said one of said bodies;

a fixed connector mateable with said detachable connector and located on the other of said bodies such that actuation of said extendable member will bring said detachable connector into mating contact with said fixed connector; and retaining means to hold said detachable connector in mating contact with said fixed connector while said extendable member is withdrawn.

3. An apparatus for remotely connecting, disconnecting and reconnecting a flexible communication means between two spaced apart bodies while allowng relative motion between said bodies with a minimal transfer of energy from one body to the other, comprising:

a nonflexible extendable member attached to a first body and capable of positive extension therefrom and retraction thereto wherein said extendable member includes a misalignment device, said misalignment device comprising an annular spherical convex surface and a mating annular spherical concave surface, said surfaces being in biased axial alignment through a plurality of circumferentially placed springs;

a detachable connector carried by said nonflexible extendable member wherein said flexible communication means is connected between said detachable connector and said first body;

a fixed connector on said second body for receiving said detachable connector; and locking means associated with said fixed connector for retaining said detachable connector with said flexible communication means while said nonflexible extendable member is retracted.

4. An apparatus for electrically connecting, disconnecting and reconnecting a spacecraft with an orbiter, said spacecraft being attached to and transported by said orbiter, said apparatus allowing relative motion between said spacecraft and said orbiter within the tolerances of the dynamic envelope therebetween while in electrical connection, comprising:

a moveable electrical receptacle associated with said orbiter;

a fixed electrical receptacle on said spacecraft for mating with said moveable electrical receptacle;

a nonflexible extendable and retractable member, said member having said moveable electrical receptacle detachably connected to one end, the other end of said nonflexible extendable and retractable member being attached to said orbiter;

a flexible cable attached between said moveable electrical receptacle and said orbiter;

positive locking means associated with said fixed electrical receptacle for locking said moveable electrical receptacle in mating postion with said fixed electrical receptacle and retaining said moveable electrical receptacle therein while said nonflexible extendable and retractable member retracts, said positive locking means also capable of release of said moveable electrical receptacle upon reextension of said nonflexible extendable and retractable member.

5. The apparatus of claim 4 wherein said nonflexible extendable and retractable member is a tube driven by a rack and pinion arrangement, said tube having a plurality of inwardly biased fingers at its end, and said moveable electrical receptacle is a short tubular member having electrical contacts at one end and an annular groove in its outer peripheral surface at the other end for mating with said inwardly biased fingers.

6. An apparatus for providing electrical connection, disconnection, and reconnection between two proximate but spaced apart bodies, while minimizing the transfer of energy from one body to the other, comprising:

an extendable and retractable member comprising a first tube fixed to one of said bodies, a second tube, slideably mounted to said first tube in telescoping fashion, and a rack and pinion drive between said first tube and said second tube for extending and retracting said second tube in said telescoping fashion;

a detachable receptacle carried by and held to said second tube by a biased retaining means, said detachable receptacle and said second tube being disengageable from one another upon application of sufficient force and movement apart along the longitudinal axis of said second tube, and said detachable connector and said second tube being reengageable upon application of sufficient force and movement together along the longitudinal axis of said second tube;

a fixed receptacle, mateable with said detachable receptacle, and located on the other of said bodies;

a flexible cable attached between said one of said bodies and said detachable receptacle; and a locking means associated with said fixed receptacle for locking said detachable receptacle when in mating contact with said fixed receptacle and, upon command, for unlocking said detachable receptacle, whereby upon extension of said second tube said detachable receptacle will be carried and locked into mating contact with said fixed receptacle, said biased retaining means allowing retraction of said second tube thereby leaving said first and second body in electrical connection through said flexible cable, and upon reextension of said second tube and a command to unlock said locking means, said detachable receptacle may be disconnected from said fixed receptacle by reengagement of said detachable receptacle with said second tube through said biased retaining means and retraction of said second tube.

7. An apparatus for providing electrical connection, disconnection, and reconnection between two proximate but spaced apart bodies, while minimizing the transfer of energy from one body to the other, comprising:

an extendable and retractable member comprising a first tube fixed to one of said bodies, a second tube, slideably mounted to said first tube in telescoping fashion, and a rack and pinion drive between said first tube and said second tube for extending and retracting said second tube in said telescoping fashion;

a detachable receptacle carried by and held to said second tube by a biased retaining means, said detachable receptacle and said second tube being disengageable from one another upon application of sufficient force and movement apart along the longitudinal axis of said second tube;

a fixed receptacle, mateable with said detachable receptacle, and located on the other of said bodies;

a flexible cable attached between said one of said bodies and said detachable receptacle; and a locking means associated with said fixed receptacle for locking said detachable receptacle when in making contact with said fixed receptacle and upon command, for unlocking said detachable receptacle wherein said locking means is a plurality of spaced apart, circularly located, spring pawls which lock with like spaced apart stepped surfaces on said detachable receptacle, said spring pawls being commonly mounted to a rotatable base for unlocking whereby upon extension of said second tube said detachable receptacle will be carried and locked into mating contact with said fixed receptacle, said biased retaining means allowing retraction of said second tube thereby leaving said first and second body in electrical connection through said flexible cable, and upon reextension of said second tube and upon rotation of said rotatable base, said detachable receptacle may be disconnected from said fixed receptacle by reengagement of said detachable receptacle with said second tube through said biased retaining means and retraction of said second tube.

8. The apparatus of claim 7 wherein said detachable receptacle includes a frustoconical nose cone for guiding into said fixed receptacle, an inner channel and an electrical connector biased forward in said channel thereby allowing limited axial and circumferential movement in mating with said fixed receptacle and providing positive electrical contact.

9. An apparatus for remotely electrically connecting two spaced apart bodies which are in predetermined relative positions to one another within given tolerances while providing for a minimum of energy transfer through the connection, comprising:

an extendable member attached to one of said bodies and capable of remote actuation;

a connector head rotatably mounted on said extendable member, said connector head having a plurality of radial ears and a first latching means;

a support ring carrying a first electrical connector and having second and third latching means, said first and second latching means allowing for disengagement between themselves upon predetermined relative rotation between said connector head and said support ring;

a second electrical connector mateable with said first electrical connector and mounted on the other of said bodies;

a fourth latching means associated with said second electrical connector for holding said first electrical connector in mating contact with said second electrical connector, said third and fourth latching means allowing for engagement between themselves upon said predetermined relative rotation between said connector head and said support ring;

a stabilizing and guide means between said support ring and the other of said bodies; and a ramp located along the path of said extendable member for engaging one of said radial ears and rotating said connector head through said predetermined relative rotation whereby when said first and second latching means are engaged and said extendable member is remotely actuated, the extension of said member will result in the stabilization of said support ring while said connector head is rotated said predetermined relative rotation thereby disengaging said first and second latching means and engaging said third and fourth latching means such that said first and second electrical connectors are firmly mated and said extendable member may be withdrawn.

10. The apparatus of claim 9 including an antirotation arm and an antirotation disengagement device for maintaining the rotational orientation of said connector head yet allowing rotation when said extendable member is actuated and said support ring is stabilized.

11. The apparatus of claim 9 wherein said first and second latching means comprise circumferentially spaced stepped surfaces and corresponding spring latches which grasp said stepped surfaces.

12. The apparatus of claim 11 wherein said third and fourth latching means respectively comprise a plurality of spring pawls and a circumferential groove which said pawls may engage.

13. The apparatus of claim 9 wherein said connector head includes a misalignment device, said misalignment device comprising an annular spherical convex surface and a mating annular spherical concave surface, said surfaces being in biased axial alignment through a plurality of circumferentially located alignment springs.

14. A method of remotely connecting a flexible communication member between two spaced apart bodies which are in predetermined relative positions to one within given tolerances while providing for a minimum transfer of energy between said bodies while so connected, comprising the steps of:

remotely actuating an extendable telescoping member from one of said bodies;

carrying a detachable receptacle with said telescoping member;

biasing a first electrical connector forward in said detachable receptacle and allowing limited circumferential and axial movement of said first electrical connector relative to said detachable receptacle, said first electrical connector having a flexible communication member attached between it and said one of said bodies;

mating said first electrical connector with a second electrical connector, said second electrical connector located on the other of said bodies;

locking said first electrical connector in a biased mating relationship with said second electrical connector; and remotely actuating the withdrawal of said extendable telescoping member while detaching said detachable receptacle therefrom.

* * * * *